US006956159B2

(12) United States Patent
Jeffries et al.

(10) Patent No.: US 6,956,159 B2
(45) Date of Patent: Oct. 18, 2005

(54) DRUM HEAD SECUREMENT DEVICE

(76) Inventors: Walter B. Jeffries, 43370 Little Nestucca Rd., Cloverdale, OR (US) 97112; Tyler D. Hauth, 43370 Little Nestucca Rd., Cloverdale, OR (US) 97112; Sarah M. Jeffries, 43370 Little Nestucca Rd., Cloverdale, OR (US) 97112

( * ) Notice: Subject to any disclaimer, the term of this patent is extended or adjusted under 35 U.S.C. 154(b) by 54 days.

(21) Appl. No.: 10/665,755

(22) Filed: Sep. 22, 2003

(65) Prior Publication Data

US 2004/0159201 A1 Aug. 19, 2004

Related U.S. Application Data

(60) Provisional application No. 60/442,271, filed on Jan. 23, 2003.

(51) Int. Cl.[7] ..... G10D 13/02
(52) U.S. Cl. ..... 84/413; 84/411 R; 84/411 A
(58) Field of Search ..... 84/413, 411 R, 84/411 A

(56) References Cited

U.S. PATENT DOCUMENTS 973,661 A 10/1910 Holton
1,619,046 A 3/1927 Ward
3,646,843 A 3/1972 Kregal
4,520,709 A 6/1985 Kester
4,570,526 A 2/1986 Hashino
4,694,726 A 9/1987 Silvestri
4,709,613 A 12/1987 Powers
4,928,566 A 5/1990 Yanagieawa
5,442,988 A * 8/1995 Mayo ..... 84/413
5,544,561 A * 8/1996 Isomi ..... 84/421
5,561,255 A 10/1996 Sassmannshausen
5,770,810 A * 6/1998 Lombardi ..... 84/411 R
6,043,421 A 3/2000 Adams
6,410,833 B1 6/2002 Brando
6,441,286 B1 8/2002 Brando
6,492,583 B1 12/2002 Wilkey
6,570,074 B1 5/2003 Rode

* cited by examiner

*Primary Examiner*—Shih-Yung Hsieh
(74) *Attorney, Agent, or Firm*—Gene W. Arant

(57) ABSTRACT

A securement device for securing a drum head upon a drum shell or body through a tension rod, including a lug assembly that not only allows a downward pull on and hence tightening of the associated tension rod, but also provides for three additional parameters of adjustment of the position and aspect of the lower end of the tension rod relative to the associated drum shell.

4 Claims, 4 Drawing Sheets

DRUM HEAD SECUREMENT DEVICE

PRIORITY CLAIM

Figure 1:
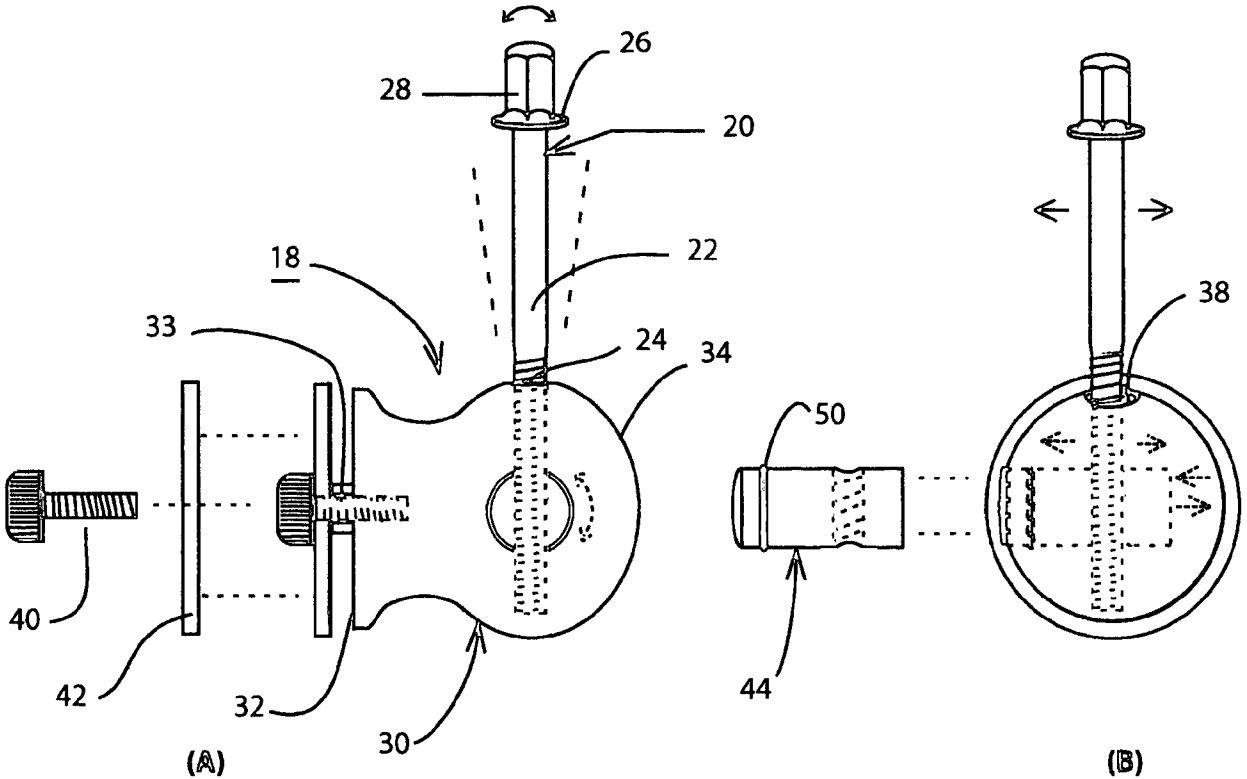

This application claims the priority of our provisional application Ser. No. 60/442,271 filed Jan. 23, 2003.

FIELD OF THE INVENTION

This invention relates to the field of musical instruments, and particularly drums.

BACKGROUND OF THE INVENTION

Conventional drums have a cylindrical body or shell with an upwardly directed flat circumferential end surface upon which a drum head of flat circular configuration is mounted. A ring shaped rim is fitted over the outer circumference of the head, the cooperating surfaces of the shell and head being such that depressing the rim downwardly tends to increase the lateral tension within the head.

A number of tensioning rods, typically about eight, are located in circumferentially spaced relationship about the periphery of the drum body or shell. The tensioning rods have their upper ends rotatably supported by the rim and extend downward about the outer wall of the cylindrical body. The lower ends of the tensioning rods are threaded, and are received in threaded securement devices which in turn are secured to the drum body so that when the tensioning rods are driven in rotation from their upper ends that will shorten them and hence tighten the drum head.

Achieving optimum adjustment of tensioning rods and associated securement devices is sometimes very difficult or inconvenient. It is desirable for the drum head to be correctly centered upon the upper end surface of the shell or body and with a uniform lateral tension throughout. The securement devices sometimes need to be replaced because of wear.

The drum head, like other musical instruments, has a basic frequency of vibration together with associated overtones at higher frequencies, to produce a characteristic musical tone. Another problem with drums is that the primary sounds generated by vibration of the drum head are sometimes accompanied by noise which is created separately by rattling of the securing devices, and is not usually compatible with the desired overall tone pattern. These noises may be referred to as side effect sounds—that is, sounds that are not desired and may be annoying to a listener.

SUMMARY OF THE INVENTION

According to the present invention a drum head securement device is provided which, in addition to allowing for vertical tightening of the associated tensioning rod, provides three additional parameters of adjustment of the position and aspect of the lower end of the associated tensioning rod.

Further, according to the invention, a method of miminimizing side effect sounds is achieved by utilizing a securement device that has two metal parts, secured to the tensioning rod and the drum body respectively, and which are clampingly engaged with an elastomeric member between them that tends to absorb and thus minimize the side effect sounds.

More particularly, according to the invention the securement device includes a metal lug having a flat rearward end surface and an end portion protruding therefrom that is adapted to extend through a hole in the wall of the drum shell or body, and having a threaded opening; a fastening screw to secure the end of the lug inside the shell or body; a transverse opening in the forwardly protruding part of the lug; a cross-pin extending into that transverse opening; an upwardly facing opening in the upper wall of the lug into which the tensioning rod extends downwardly, the cross-pin having a transverse threaded opening to threadedly receive the tensioning rod; the cross-pin being rotatable about its own longitudinal axis relative to the transverse opening in the lug; and the upwardly facing opening in the upper wall of the lug being of sufficient expanse that the cross-pin may also slide longitudinally within the transverse opening to adjust the lateral position of the lower end of the tensioning rod.

Also in accordance with the invention the upwardly facing opening allows the tensioning rod to twist in a vertical plane perpendicular to the flat end surface of the metal lug when the cross-pin rotates within the transverse opening.

Further according to the preferred form of the invention a rubber ring mounted on the cross-pin shields its vibrations from the lug and hence from the drum shell or body.

DRAWING SUMMARY

Figure 2:
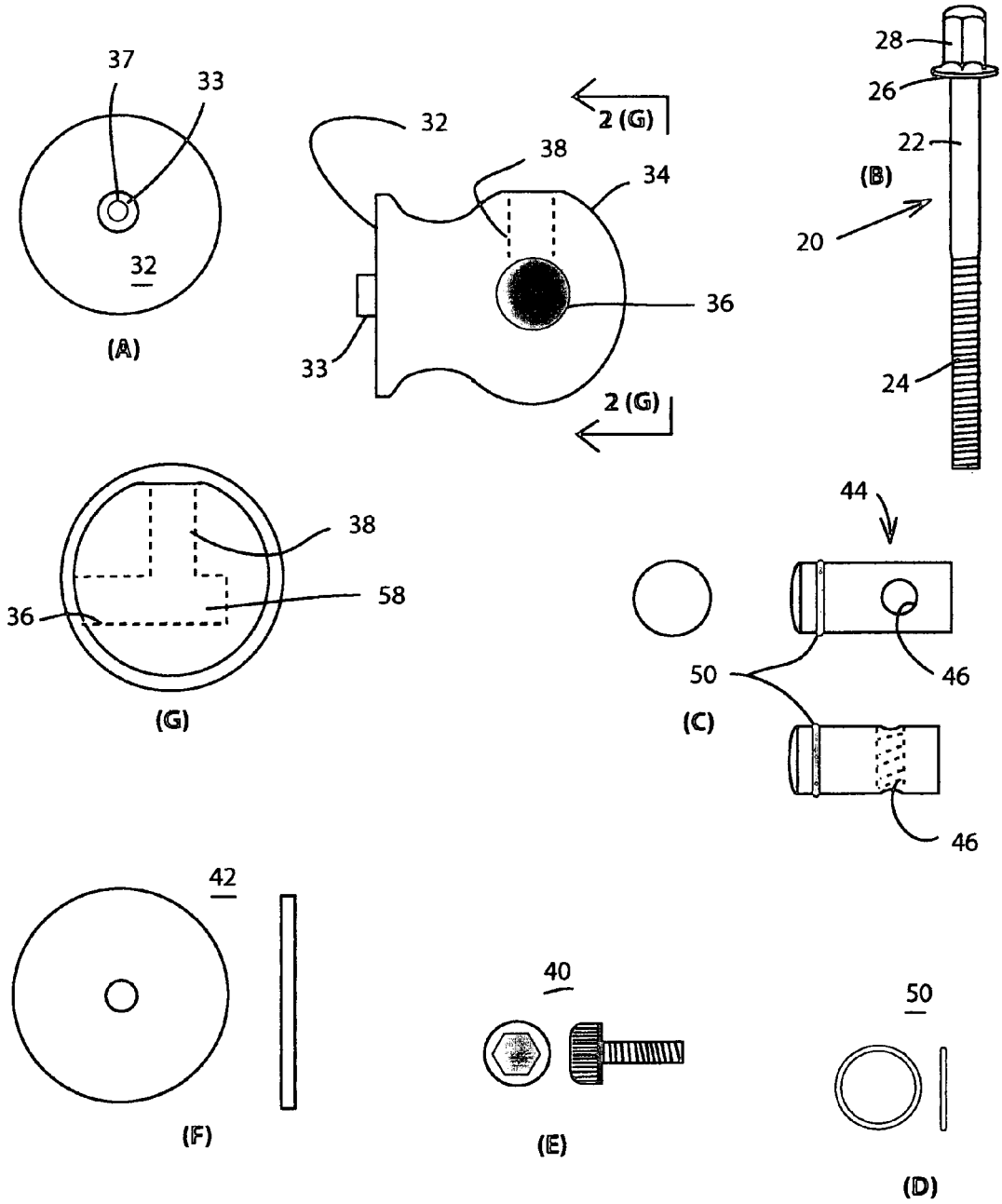
Figure 3:
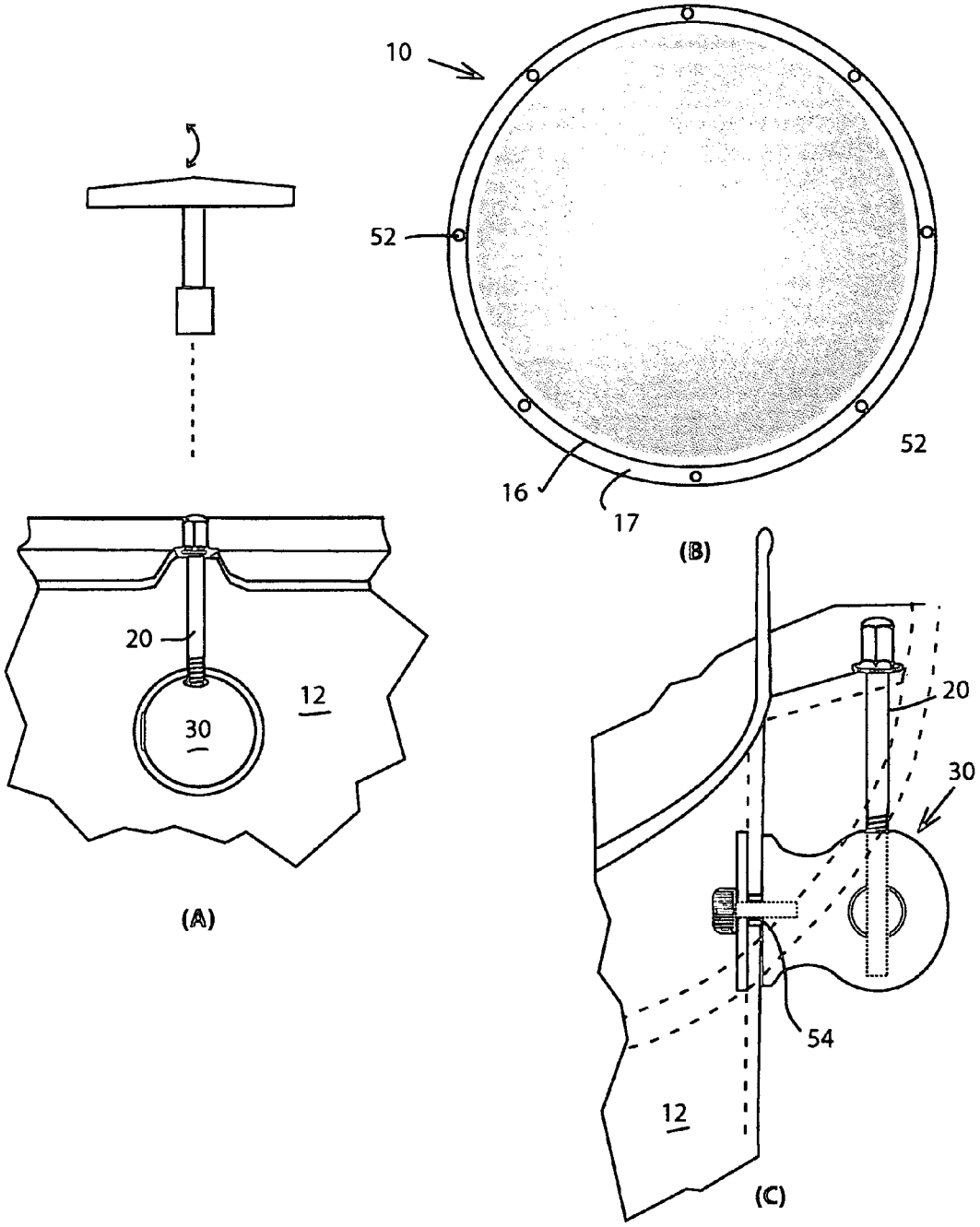
Figure 4:
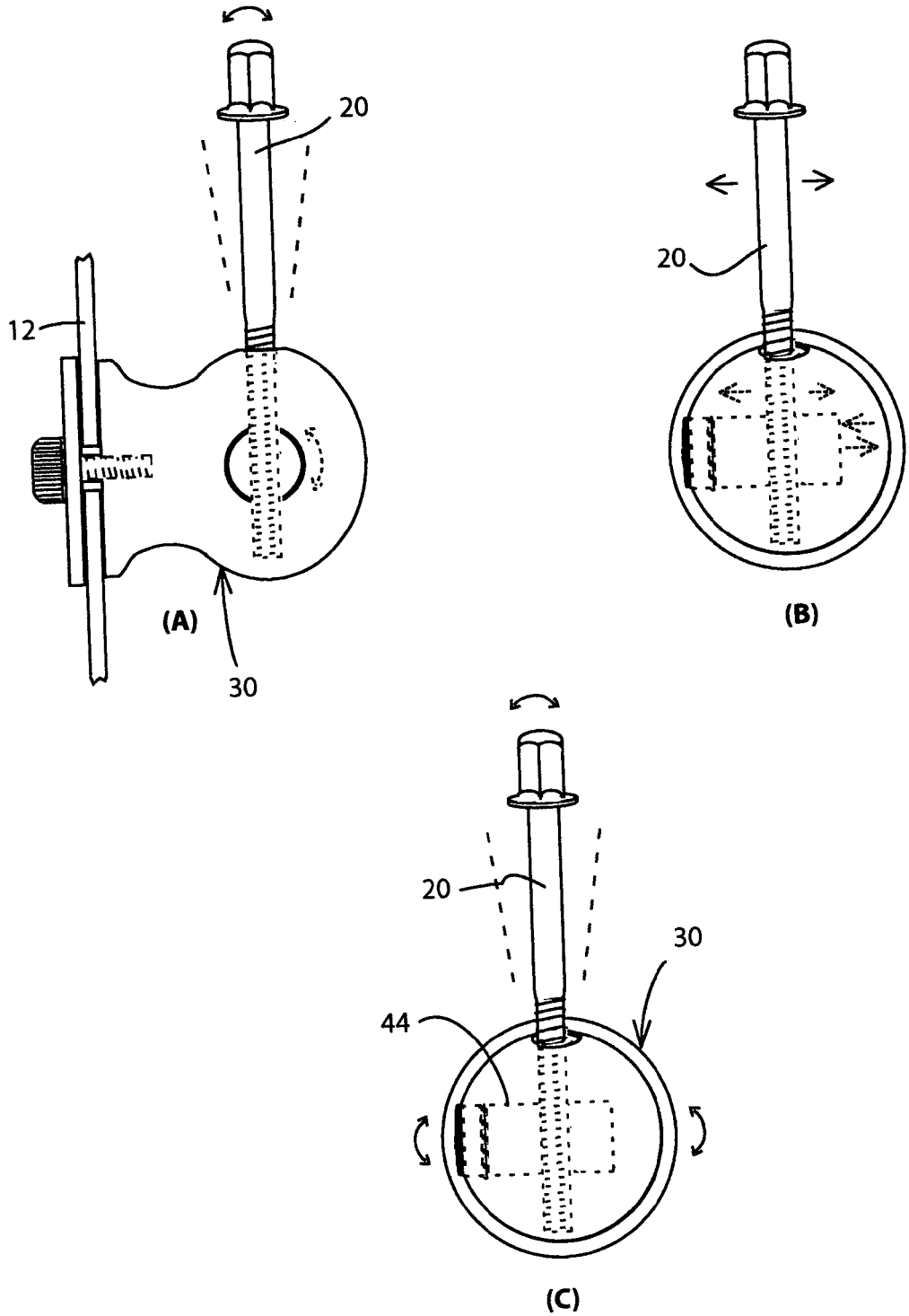

FIG. 1(*a*) has front elevation view and FIG. 1(*b*) a side elevation view of the lug assembly of the present invention with partially exploded displays of the parts to show their relationship to each other;

FIG. 2 shows structural details of the various parts of the securement device, including the lug body in FIG. 2(*a*), the tensioning rod in 2(*b*), the cross-pin in 2(*c*), the O-rim in 2(*d*), the fastening screw in 2(*e*), and the washer in 2(*f*);

FIGS. 3(*a*), 3(*b*), and 3(*c*) show the drum head, the circumferential rim, and tensioning rods holding the rim and drum head down; and FIG. 4 shows the three adjustments of the position and aspect which the lug assembly can make in the lower end of the associated tensioning rod, including twisting of the tension rod and cross-pin in FIG. 4(*a*), lateral movement of the rod end in 4(*b*), and twisting of the lug body and tension rod about the axis of the fastening screw.

DETAILED DESCRIPTION

Referring now to the drawings, a drum assembly 10 includes a shell or body 12 of generally cylindrical configuration.

A flat circular drum head 14 is supported on the flat upper end surface of the shell or body, and is held down by a circular rim 16. Rim 16 has a circumferential flange 17 through which holes 52 are formed in circumferentially spaced relation around the drum body.

There are a plurality of tensioning assemblies 18, preferably eight of them to accommodate the entire instrument. One of the tensioning assemblies is shown in complete detail in the various drawings. Each tensioning assembly includes a tension rod 20 and a lug 30. The tension rod 20 has an elongated shank 22 with a collar 26 at its upper end, above which is a wrench-engageable portion 28. The lower end 24 of the tension rod 20 is threaded.

Lug body 30 has a flat face 32 that engages the outer surface of drum shell 12. The opposite portion of lug body 30 is preferably rounded in a knob-like surface 34 for convenience of the user. A transverse opening 36 is formed in one side of the lug body, and it also has an upwardly facing opening 38. Openings 36 and 38 are intersecting and in mutually perpendicular relation. In the present illustration neither of those openings extends all the way through the lug body 30, and although that is not necessary it would be permissible.

Lug body 30 also has a spud portion 33 which protrudes from flat face 32 and extends through an opening 54 in the adjacent wall of drum body 12. The spud 33 has a threaded opening 37. A screw or threaded bolt 40 positioned inside the drum shell engages the opening 37 to secure the lug body 30 to the drum shell 12. Lug body 30 is therefore able to rotate relative to the drum shell or body about the horizontal axis of the spud 33, which—coincides with a radius of the drum shell. A washer 42 is used in conjunction with the outer end of screw 40.

A cross-pin 44 occupies a large portion of the length of transverse opening 36 in the lug body. The cross-pin has its own transverse threaded opening 46 near one end, which is adapted to receive the threaded lower end 24 of the tension rod 20. Upwardly facing opening 38 in the lug body 30 is of wider extent in two dimensions than the diameter of the lower end 24 of the tension rod 20. Thus, the lower end 24 of the tension rod 20 may move in either of two mutually perpendicular planes relative to the lug body. These motions are possible because the cross-pin may rotate about its own axis and the axis of fastening screw 40 relative to the lug body; and a space 58 normally remains within the inner end of transverse opening 36 into which the cross-pin 44 may extend.

In accordance with a preferred form of the invention an O-ring 50 is seated in an annular groove on cross-pin 44. This shields the drum body or shell from receiving the full impact of any vibrations that may be extraneously introduced to the tension rod 20.

While a particular embodiment of the invention has been disclosed in detail in order to comply with requirements of the patent laws, it will be understood that the scope of the invention is to be determined only in accordance with the appended claims.

We claim:

1. A drum system comprising, in combination:

a drum shell of generally cylindrical configuration;

a drum head of generally flat circular configuration and being adapted to rest upon the upper extremity of the shell;

a ring shaped rim fitted over the outer circumference of the head, the cooperating surfaces of the shell and head being such that depressing the rim downwardly tends to increase lateral tension in the head;

a tensioning rod having an upper end rotatably supported from a point on the circumference of the rim, and a threaded lower end;

a lug assembly secured on the outer surface of the shell adjacent the lower end of the tensioning road and rotatable about a horizontal axis that extends radially relative to the shell;

the lug assembly having a lug body with an upwardly directed opening adapted to receive the lower end of the tensioning rod;

the lug body also having a transverse opening that intersects the top opening in a mutually perpendicular relationship;

a cross-pin disposed within the transverse opening and movable both rotatably and longitudinally relative thereto;

the cross-pin having a threaded transverse opening engageable by the threaded lower end of the tensioning; and the top opening in the lug body being of greater dimension than the threaded lower end of the tensioning rod in directions both perpendicular to and parallel to the adjacent surface of the shell.

2. A drum head securement device comprising:

a tensioning rod adapted to extend downwardly through a hole in a drum head rim, having a flange on its upper end to maintain its vertical position relative to the rim, its upper end above the flange being also wrench engageable for rotation relative to the rim, and the rod also being threaded on its lower end;

a lug body having a flat surface adapted to engage the outer surface of a drum shell, and a spud projecting from its flat surface for insertion into and through an opening in the shell;

a fastening screw for securing the spud inside the shell, the lug thereby being rotatably adjustable about the longitudinal axis of the spud;

the lug body having a transverse side opening and an upwardly directed top opening that intersect and are mutually perpendicular;

a cross-pin disposed within the side opening of the lug body and movable both rotatably and longitudinally relative thereto;

the cross-pin having a threaded transverse opening engageable by the threaded lower end of the tensioning rod so that the tensioning rod may be driven in rotation to tighten it and hence depress an associated radial edge of the head; and the top opening in the lug body being of greater dimension than the lower end of the tensioning rod in directions both perpendicular to and parallel to the adjacent surface of the shell, whereby the lower end of the tension rod may either twist in a vertical plane perpendicular to the adjacent surface of the drum shell, or may move laterally in a plane parallel to the drum shell surface.

3. In a drum assembly having a drum shell of generally cylindrical configuration, a drum head, a rim on the head, and a tensioning rod with an upper end supported on the rim and a thread lower end which extends downwardly, a lug assembly comprising:

a lug body secured on the outer surface of the shell and rotatable about a horizontal axis that extends radially relative to the shell, the lug body having a top opening for receiving the lower end of the tensioning rod, the lug body also having a transverse opening that intersects the top opening in a mutually perpendicular relationship; and a cross pin disposed with the transverse opening in the lug body and movable both rotatably and longitudinally therein, the cross pin having a threaded opening engageable by the lower end of the tensioning rod.

4. A lug assembly as in claim 3 wherein the top opening in the lug body is of larger diameter than the lower end of the tensioning rod.

* * * * *